US007338412B2

(12) United States Patent
Nakanishi

(10) Patent No.: US 7,338,412 B2
(45) **Date of Patent: *Mar. 4, 2008**

(54) ROCKING EXERCISE APPARATUS

(75) Inventor: Ryusuke Nakanishi, Nagoya (JP)

(73) Assignee: Matsushita Electric Works, Ltd., Osaka (JP)

( * ) Notice: Subject to any disclaimer, the term of this patent is extended or adjusted under 35 U.S.C. 154(b) by 12 days.

This patent is subject to a terminal disclaimer.

(21) Appl. No.: 11/237,673

(22) Filed: Sep. 29, 2005

(65) Prior Publication Data

US 2006/0073939 A1 Apr. 6, 2006

(30) Foreign Application Priority Data

Oct. 1, 2004 (JP) ..... 2004-290135
Nov. 18, 2004 (JP) ..... 2004-334230

(51) Int. Cl.
*A63B 69/04* (2006.01)

(52) U.S. Cl. ..... 482/51; 434/247; 472/59

(58) Field of Classification Search ..... 482/51, 482/1–9; 472/29, 97, 59–80; 434/247, 255
See application file for complete search history.

(56) References Cited

U.S. PATENT DOCUMENTS 1,671,162 A * 5/1928 Peters ..... 472/97
2,915,311 A * 12/1959 Delano ..... 472/97
3,997,979 A * 12/1976 Turner ..... 472/29

(Continued)

FOREIGN PATENT DOCUMENTS

JP 6-65350 8/1994
JP 2004-216072 8/2004

OTHER PUBLICATIONS

English Language translation of claim 1 of JP 6-65350.
English Language Abstract of JP 2004-216072.

(Continued)

*Primary Examiner*—Stephen R. Crow
(74) *Attorney, Agent, or Firm*—Greenblum & Bernstein, P.L.C.

(57) ABSTRACT

A rocking exercise apparatus is provided with a motor and a driving unit for translating a torque of an output rotary shaft of the motor into rocking movements of a seat seated by a user. This driving unit includes a first supporter for supporting a movable mount provided on a base such that the movable mount can make reciprocating pivotal movements about a longitudinal shaft inclined with respect to longitudinal direction; a second supporter for supporting a pedestal fixedly attached to the seat such that the pedestal can make reciprocating pivotal movements about transverse shafts provided in the movable mount via connection links; a first driving portion for translating the rotary motion of the output rotary shaft of the motor into reciprocating linear movements of the pedestal along longitudinal direction and reciprocating pivotal movements about a transverse axis via the second supporter; and a second driving portion for translating the rotary motion of the output rotary shaft of the motor into reciprocating pivotal movements of the pedestal about a longitudinal axis and reciprocating pivotal movements about a vertical axis via the first supporter. An angle of inclination of the movable mount with respect to a center axis of the reciprocating pivotal movements in at least either one of the first and second supporters is changeable. Accordingly, the rocking exercise apparatus can give a larger fitness effect by complicating the movements while being small and inexpensive.

7 Claims, 8 Drawing Sheets

U.S. PATENT DOCUMENTS 5,085,425 A * 2/1992 Collins et al. ..... 472/97
7,070,415 B2 * 7/2006 Hojo et al. ..... 434/247
7,121,831 B2 * 10/2006 Hojo et al. ..... 434/247

OTHER PUBLICATIONS

U.S. Appl. No. 11/188,666 to Nakano et al., filed on Jul. 26, 2005.
U.S. Appl. No. 11/237,734 to Nakanishi, filed on Sep. 29, 2005.

* cited by examiner

ROCKING EXERCISE APPARATUS

BACKGROUND OF THE INVENTION

1. Field of the Invention

The present invention relates to a rocking exercise apparatus that produces a variety of rocking motions in order to provide exercise to users mounted on a seat of the apparatus.

2. Description of the Related Art

Rocking exercise apparatuses that produce a variety of rocking motions in order to provide exercise to users mounted on a seat of the apparatus were initially predominantly used in health and fitness clubs. Now, these rocking exercise apparatuses can also be found in households as a convenient exercise apparatus for the entire family, young and old. Conventional rocking exercise apparatuses are disclosed, for example, in Japanese Examined Patent Publication No. H06-65350 and Japanese Unexamined Patent Publication No. 2004-216072.

The technology disclosed in Japanese Examined Patent Publication No. H06-65350 relates to a training apparatus for preventing low back pain by realizing a series of rocking patterns using a 6-axis parallel mechanism.

The technology disclosed in Japanese Unexamined Patent Publication No. 2004-216072 relates to a balance training apparatus which realizes three kinds of movements including reciprocating linear movements of a seat along longitudinal direction, reciprocating pivotal movements thereof about a longitudinal axis and reciprocating pivotal movements thereof about a transverse axis by a compact driving apparatus.

Japanese Examined Patent Publication No. H06-65350 discloses that the training apparatus houses six driving sources that are separately controlled. Because the driving sources are separately controlled, the operation timings, speeds and ranges of each driving source are fairly complicated and thus, require complicated controls. Additionally, because six separately controlled driving sources are present, the apparatus is large and thus, increases production costs.

Japanese Unexamined Patent Publication No. 2004-216072 discloses that the seat only generates three types of movements including, reciprocating linear movements of the seat along a longitudinal direction, reciprocating pivotal movements of the seat about the longitudinal axis and reciprocating pivotal movements of the seat about a transverse axis. Since only three types of movements are available, the apparatus is limiting and monotonous for users. Thus, there is a demand for an improved rocking exercise apparatus that provides a wider, more complicated range of movements for better fitness.

SUMMARY OF THE INVENTION

A feature of the present invention provides a compact and inexpensive rocking exercise device that can generate a wider, more complicated range of movements for better fitness.

According to an aspect of the present invention, a rocking exercise apparatus is provided with a driving source and a rocking mechanism for translating a torque of an output rotary shaft of the driving source into rocking movements of a seat mounted by a user. The rocking mechanism includes: a first supporter for supporting a movable mount provided on a base such that the movable mount can make reciprocating pivotal movements about a longitudinal axis, a second supporter for supporting a pedestal fixedly attached to the seat such that the pedestal can make reciprocating pivotal movements about a transverse shaft provided in the movable mount via a connection link, a first translating mechanism for translating the rotary motion of the output rotary shaft of the driving source into reciprocating linear movements of the pedestal along longitudinal direction and reciprocating pivotal movements of the pedestal about a transverse axis via the second supporter, a second translating mechanism for translating the rotary motion of the output rotary shaft of the driving source into reciprocating pivotal movements of the pedestal about the longitudinal axis via the first supporter, and a changer for changing the movement condition of the reciprocating pivotal movement of at least one of the first supporter and the second supporter.

These and other objects, features, aspects and advantages of the present invention will become more apparent upon a reading of the following detailed description and accompanying drawings.

DETAILED DESCRIPTION OF THE PREFERRED EMBODIMENTS OF THE INVENTION

First Embodiment

Figure 1:
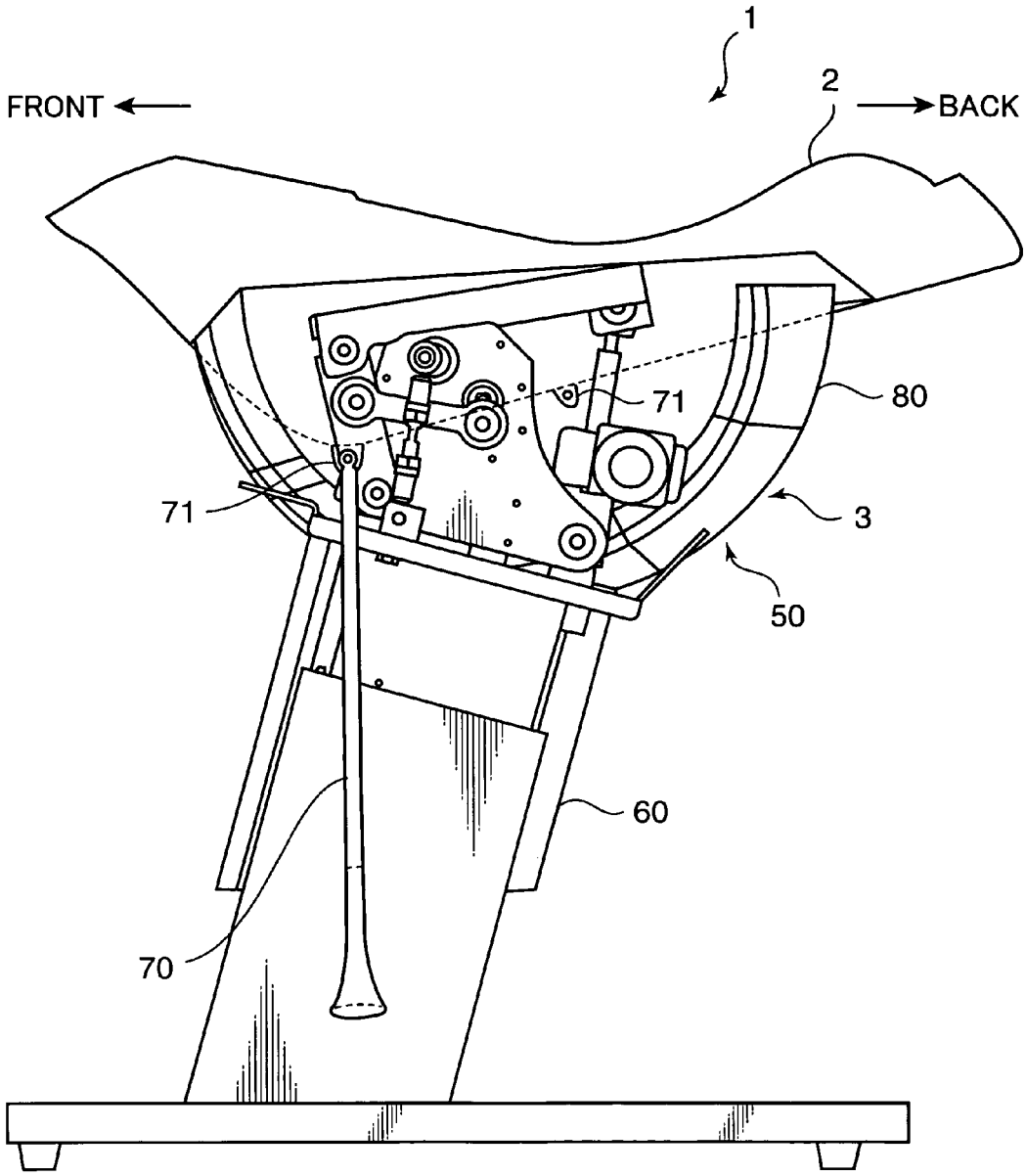
FIG. 1 is a side view showing the entire construction of a rocking exercise apparatus according to a first embodiment of the invention.

FIG. 1 is a side view showing the entire construction of a rocking exercise apparatus according to a first embodiment of the present invention. This rocking exercise apparatus 1 is provided with a seat 2 having the shape simulating a horseback or a saddle and to be seated by a user, a driving unit 2 as a rocking mechanism provided in the seat 2 to rock the seat 2, an elevating mechanism 50 for moving a rear part of the seat 2 upward and downward, a leg portion 60 supporting the seat 2 and the driving unit 3, stirrups 70 for resting the user's feet and a cover 80. In order to provide a better comfort when the user is seated on the seat 2, the stirrups 70 are preferably suspended near the center below the seat 2 when the seat 2 is horizontal while being suspended near positions right below a supporting point of rotation 4*a* of a pedestal 4 when the seat is inclined forward as shown in FIG. 1. Accordingly, mount seats 71 are provided at two positions in the middle and the bottom below the seat 2 at each side, so that the stirrups 70 can be suitably remounted depending on the posture of the seat 2.

Figure 2:
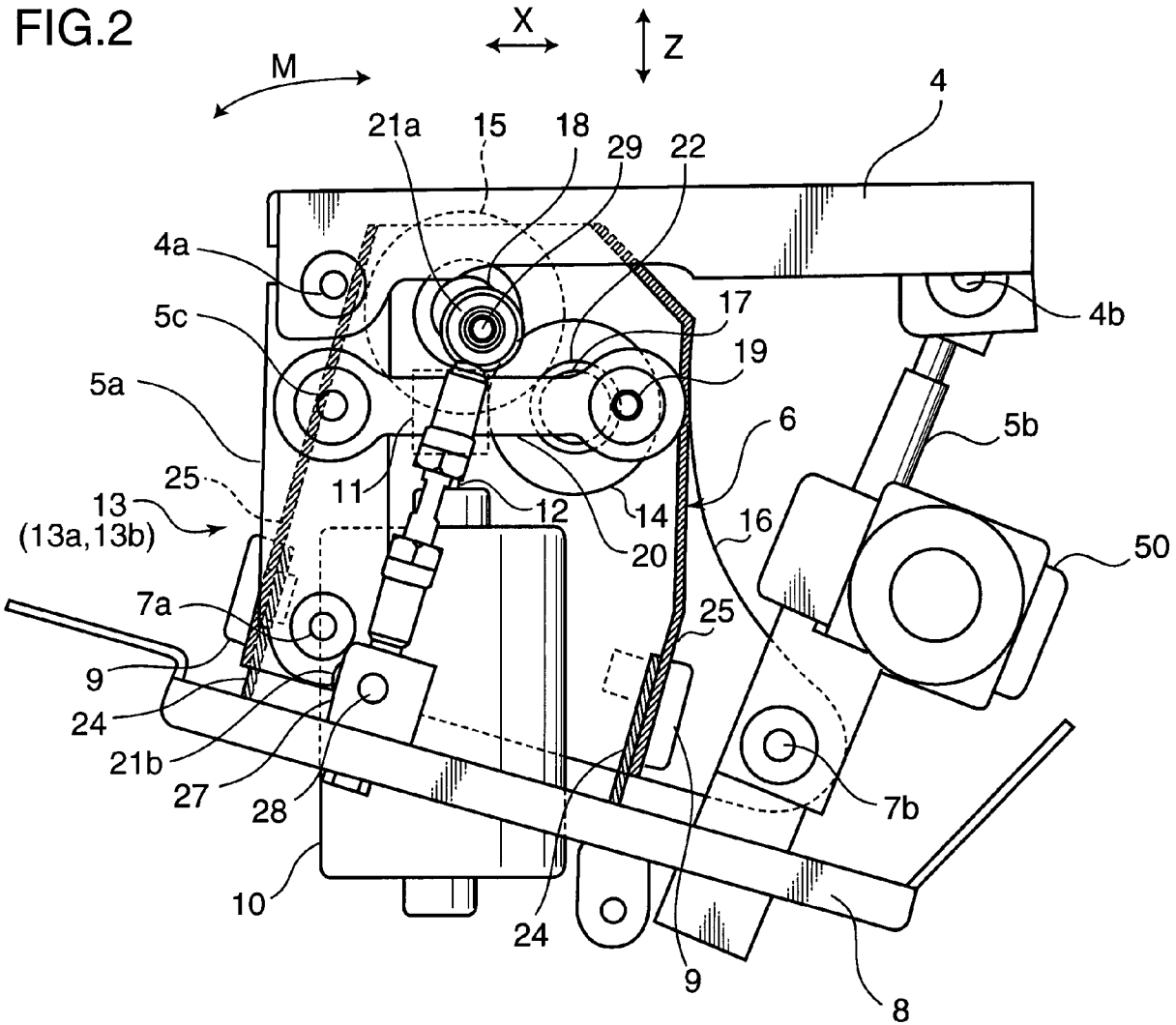
FIG. 2 is a side view enlargedly showing a driving unit provided in the rocking exercise apparatus shown in FIG. 1.
Figure 3:
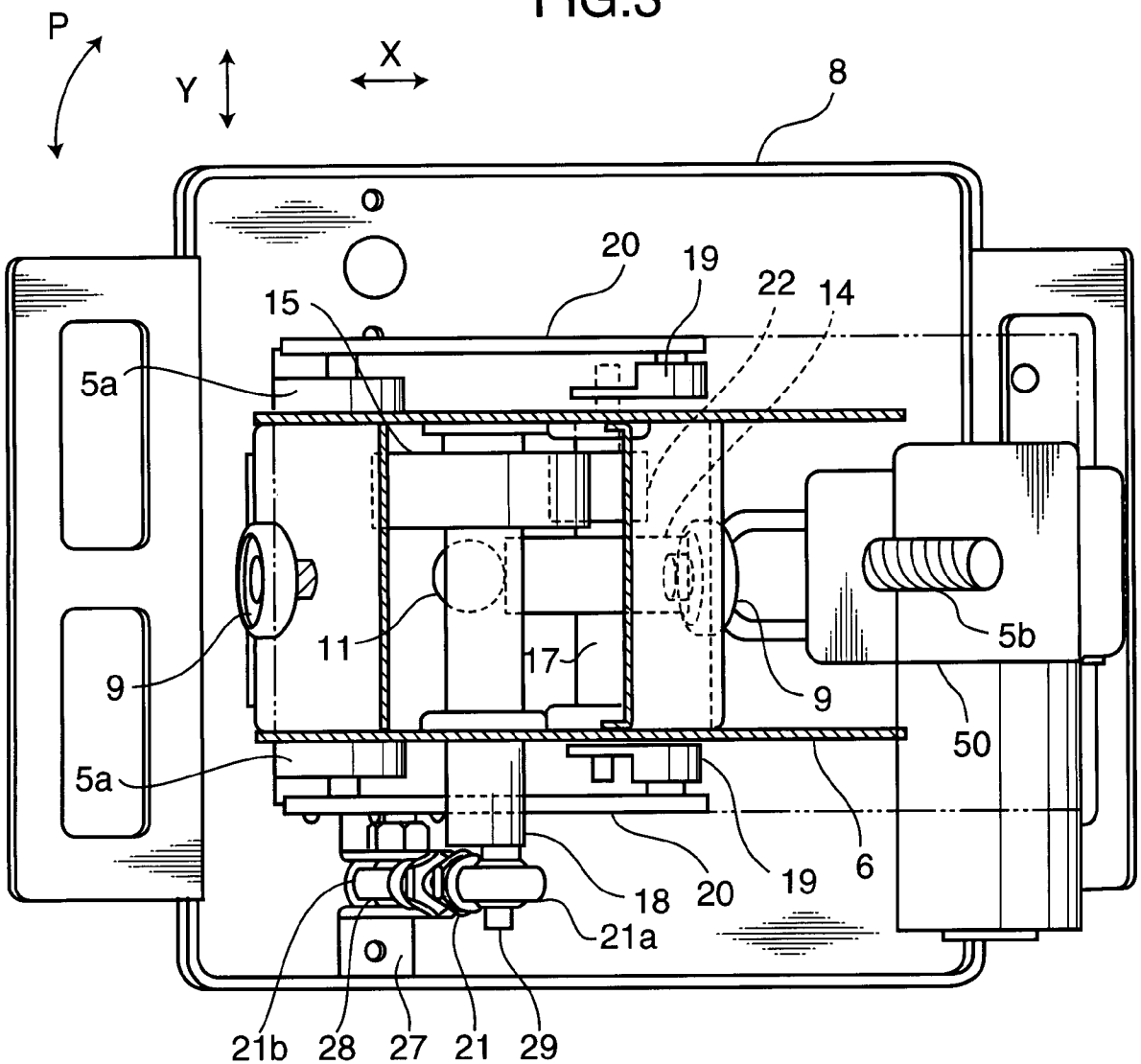
FIG. 3 is a plan view of the driving unit shown in FIG. 2.
Figure 4:
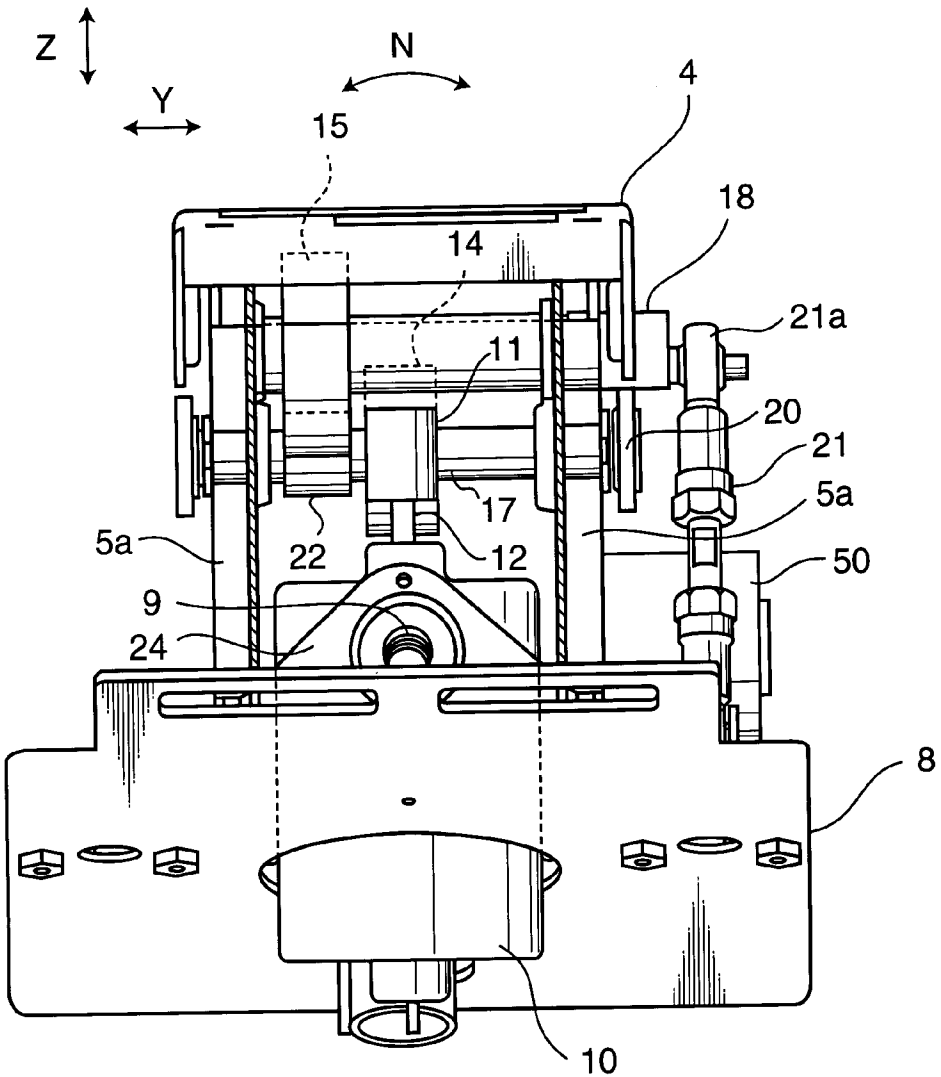
FIG. 4 is a front view of the driving unit shown in FIG. 2.

FIG. 2 is a side view enlargedly showing the driving unit 3 of the rocking exercise apparatus 1, FIG. 3 is a plan view of the driving unit 3, and FIG. 4 is a front view of the driving unit 3. In any of FIGS. 2 to 4, the frontmost plate is detached to show the inside of the driving unit 3. In FIGS. 2 to 4, the pedestal 4 on which the seat 2 is mounted is so supported on a movable mount 6 via connection links 5*a*, 5*b* as to rock forward and backward (second supporter), the movable mount 6 is so supported on a base 8 inclined down toward the back as to rock to left and right (first supporter) and a driving device 13 is accommodated between the pedestal 4 and the movable mount 6. The connection links 5*a* are front links provided at the left and right sides of the pedestal 4, whereas the connection link 5*b* is a rear link provided in the widthwise center of the pedestal 4. The upper ends of the front links 5*a* are rotatably mounted on upper shaft pins 4*a* provided at the front end of the pedestal 4, whereas the bottom ends thereof are rotatably mounted on lower shaft pins 7*a* provided at the front ends of side plates 16 of the movable mount 6. Further, the upper end of the rear link 5*b* is rotatably mounted on an upper shaft pin 4*b* provided at the rear end of the pedestal 4, whereas the bottom end thereof is rotatably mounted on a lower shaft pin 7*b* provided at the rear ends of the side plates 16 of the movable mount 6. The respective front and rear lower shaft pins 7*a*, 7*b* construct transverse shafts for rotatably supporting the connection links 5*a*, 5*b* about an axis line of transverse direction Y, whereby the pedestal 4 can make reciprocating pivotal movements along longitudinal direction shown by arrows M in FIG. 2 about the transverse shafts 7*a*, 7*b*.

As shown in FIGS. 2 and 4, shaft supporting plates 24 stand at the opposite ends of the base 8 and coupling plates 25 facing the shaft supporting plates 24 hang down from the opposite ends of the movable mount 6, wherein the coupling plates 25 are rotatably coupled to the corresponding shaft supporting plates 24 via longitudinally inclined shafts 9 extending in parallel with the base 8. The longitudinally inclined shafts 9 are arranged at two front and rear positions in a middle portion of the base 8 to rotatably support the movable mount 6 about the longitudinally inclined shafts 9, whereby the pedestal 4 can make reciprocating pivotal movements along transverse direction shown by arrows N in FIG. 4 and also reciprocating pivotal movements about the vertical axis shown by arrows P in FIG. 3.

On the other hand, the driving device 13 is provided with a single motor (driving source) 10, and two driving portions 13*a*, 13*b* for translating a torque from an output rotary shaft 12 of the motor 10 into reciprocating linear movements of the pedestal 4 along longitudinal direction X, reciprocating pivotal movements thereof about the transverse shafts 7*a*, 7*b*, reciprocating pivotal movements thereof about a virtual longitudinal axis and reciprocating pivotal movements thereof about a virtual vertical axis and driving the seat 2 by combining these four kinds of movements. The motor 10 of this example is vertically placed in the movable mount 6 on the base 8, and the output rotary shaft 12 projects upward.

The first driving portion 13*a* is for the reciprocating linear movements along longitudinal direction X and the reciprocating pivotal movements about the transverse shafts 7*a*, 7*b* (first translating mechanism), whereas the second driving portion 13*b* is for the reciprocating pivotal movements about the longitudinal axis and the reciprocating pivotal movements about the vertical axis (second translating mechanism). As shown in FIGS. 2 and 3, the first driving portion 13*a* includes a first shaft (first transverse shaft) 17 coupled to the output rotary shaft 12 via a motor gear 11 and a first gear 14, an eccentric crank 19 eccentrically coupled to an end of the first shaft 17, and an arm link 20 having one end coupled to the eccentric crank 19 and the other end rotatably mounted on a shaft pin 5*c* provided on the front link 5*a*. The opposite ends of the first shaft 17 are respectively rotatably supported on the movable mount 6, and the eccentric crank 19 makes eccentric circular movements with respect to the first shaft 17, whereby the front link 5*a* is reciprocated along longitudinal direction X via the arm link 20 and the pedestal 4 coupled to the connection links 5, i.e. the seat 2 can rock along directions shown by arrows M in FIGS. 1 and 2. The eccentric crank 19 and the arm link 20 construct a crank arm.

As shown in FIGS. 3 and 4, the second driving portion 13*b* includes a second shaft (second transverse shaft) 18 coupled to a transmission gear 22 of the first shaft 17 via a second gear 15, and an eccentric rod 21 having one end coupled to an end of the second shaft 18 in an eccentric manner and having the other end rotatably coupled to the base 8. The opposite ends of the second shaft 18 are rotatably supported on the movable mount 6. The eccentric rod 21 is arranged at either the left or right side of the movable mount 6 (right side in FIGS. 3 and 4); an upper end 21*a* of the eccentric rod 21 is coupled to the end of the second shaft 18 in an eccentric manner by a shaft pin 29 shown in FIG. 3; and a bottom end 21*b* of the eccentric rod 21 is rotatably-coupled to an L-shaped fitting 27 fixedly attached to the base 8 by a shaft pin 28. Accordingly, the upper end 21*a* of the eccentric rod 21 makes eccentric circular movements as the second shaft 18 revolves, whereby the pedestal 4, i.e. the seat 2 can make reciprocating pivotal movements about the longitudinal axis as shown by arrows N in FIG. 4 and can also make reciprocating pivotal movements about the vertical axis as shown by arrows P in FIG. 3.

Figure 5:
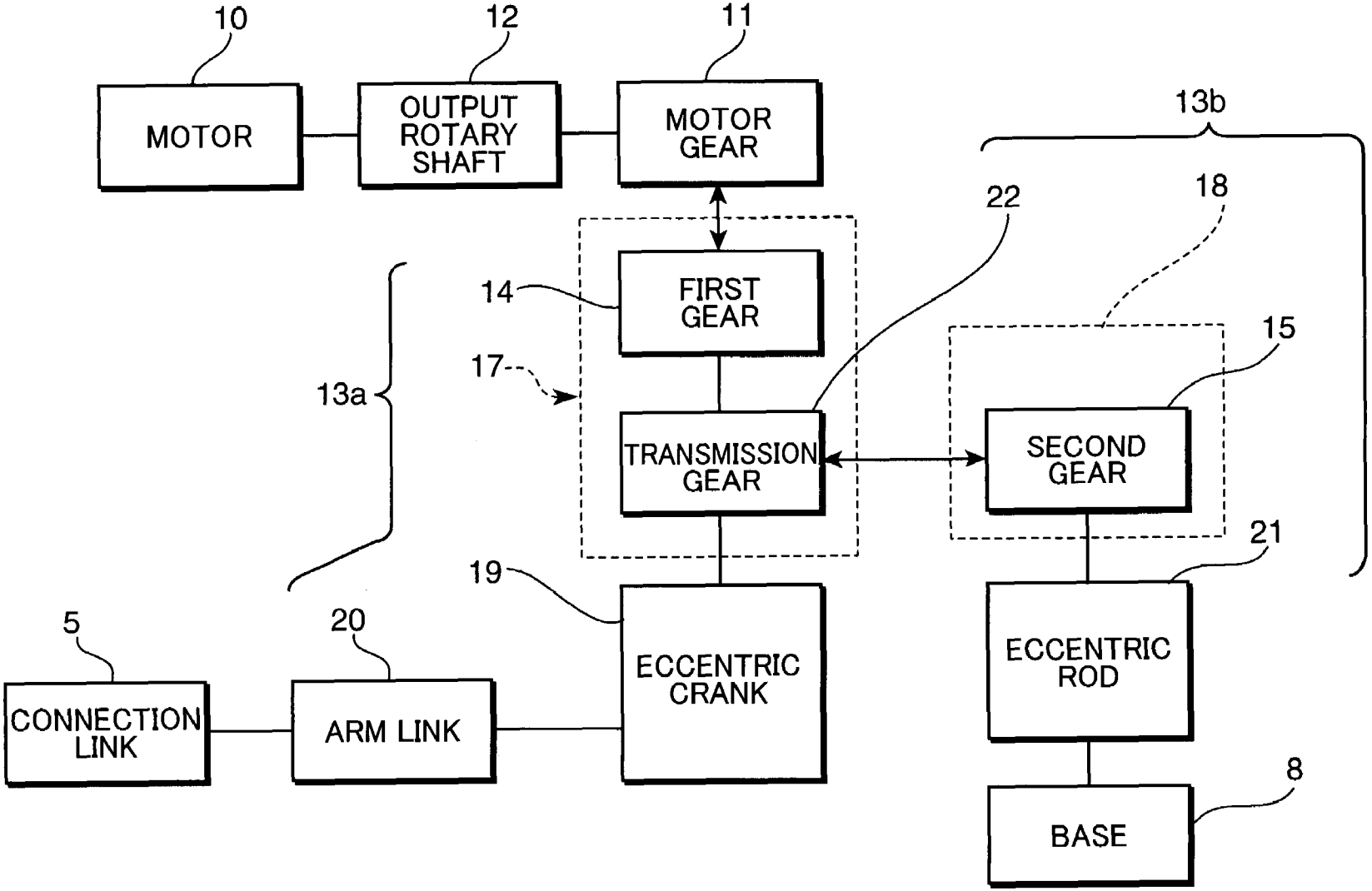
FIG. 5 is a block diagram showing a driving system of the rocking exercise apparatus.

Complicated movements of the seat 2 can be realized by way of these driving systems. FIG. 5 is a diagram showing the driving system of the rocking exercise apparatus 1. The elevating mechanism 50 is so constructed as to make upward and downward movements combined with the respective exercise modes if necessary.

Hereinafter, the operation of the rocking exercise apparatus 1 is described.

When the output rotary shaft 12 projecting in one direction from the motor 10 is rotated, the first shaft 17 is rotated by the engagement of the motor gear 11 and the first gear 14 and, simultaneously, the second shaft 18 is rotated by the engagement of the transmission gear 22 of the first shaft 17 and the second gear 15. When the first shaft 17 is rotated, the eccentric crank 19 coupled to the end of the first shaft 17 makes eccentric circular movements, whereby the front link 5*a* pivots in longitudinal direction X about the front transverse shaft 7*a* via the arm link 20. Since the rear link 5*b* cooperates to pivot about the rear transverse shaft 7*b* at this time, the pedestal 4, i.e. the seat 2 is reciprocated and rocked along longitudinal direction X. On the other hand, the upper end of the eccentric rod 21 makes eccentric circular movements by the rotation of the second shaft 18, whereby the pedestal 4, i.e. the seat 2 makes reciprocating pivotal movements about the longitudinally inclined shafts 9.

As described above, according to the first embodiment, the movable mount 6 provided on the base 8 is so supported as to make reciprocating pivotal movements about the longitudinally inclined shafts 9 inclined down toward the back (first supporter); the pedestal 4 fixedly attached to the seat 2 is so supported as to make reciprocating pivotal movements about the transverse shafts 7*a*, 7*b* provided in the movable mount 6 via the connection links 5*a*, 5*b* (second supporter); the rotary motion of the output rotary shaft 12 of the motor 10 is translated into the reciprocating linear movements of the pedestal 4 along longitudinal direction and the reciprocating pivotal movements thereof about the transverse axis via the second supporter by the first driving portion 13*a*; the rotary motion of the output rotary shaft 12 of the motor 10 is translated into the reciprocating pivotal movements of the pedestal 4 along the longitudinal axis and the reciprocating pivotal movements thereof about the vertical axis via the first supporter by the second driving portion 13*b*. Four kinds of movements, i.e. a sum of the conventional three kinds of movements disclosed in Unexamined Patent Publication No. 2004-216072 and one kind of movements are made possible to complicate the exercise. Thus, a larger fitness effect than ever before can be obtained. Further, since only one motor 10 is provided as the driving source, it is possible to facilitate the control therefore and reduce the production cost. Further, the exercise apparatus can be made smaller by narrowing the installation space of the driving unit 3.

Second Embodiment

Figure 6:
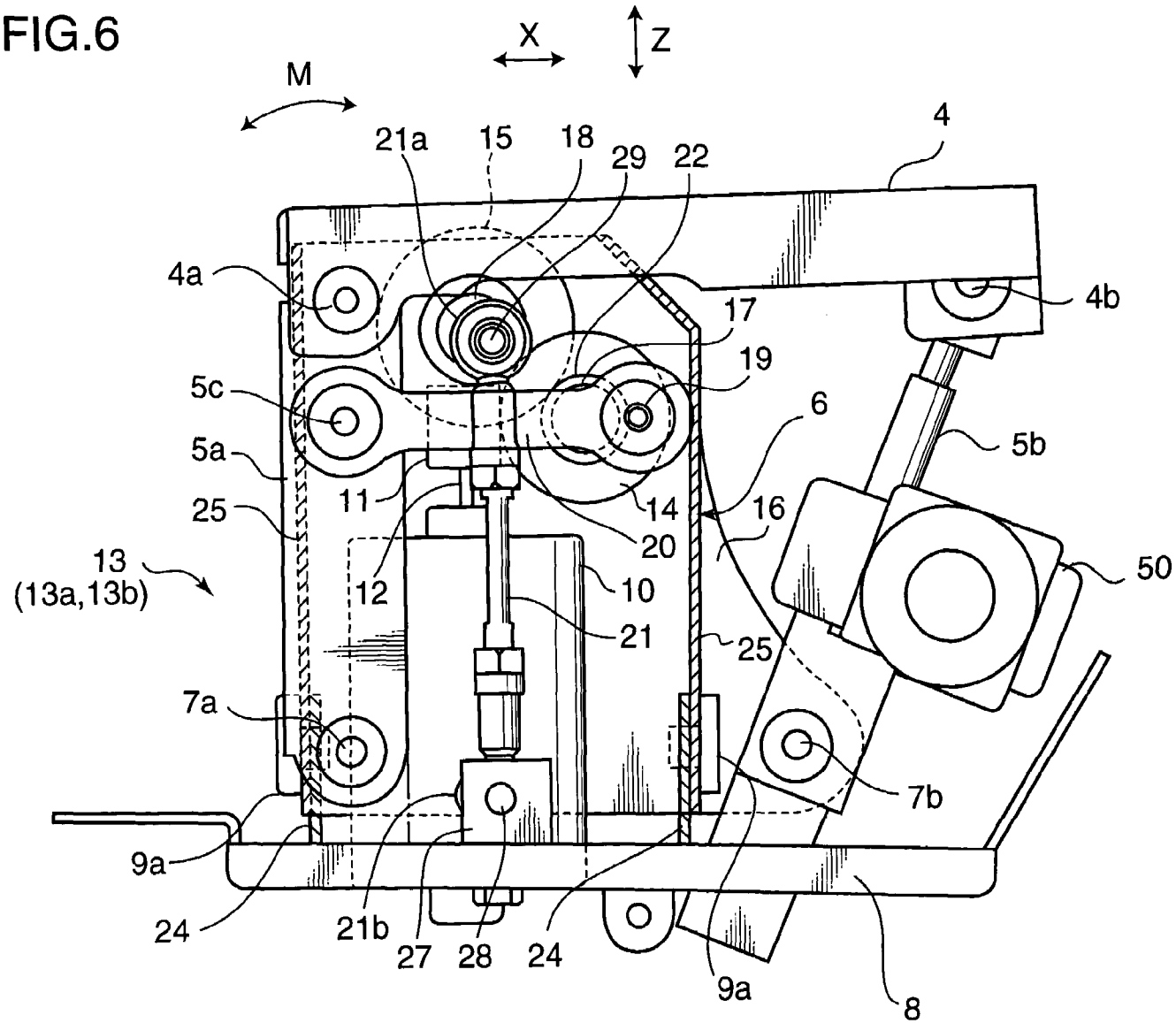
FIG. 6 is a side view showing the entire construction of a driving unit of a rocking exercise apparatus according to a second embodiment of the invention.

Although four kinds of movements are made possible by providing the longitudinally inclined shafts 9 in the first embodiment, a function of inclining forward and backward may be added to the conventional three kinds of movements disclosed in Unexamined Patent Publication No. 2004-216072. FIG. 6 is a side view showing the entire construction of a driving unit of a rocking exercise apparatus 1*a* according to a second embodiment.

In FIG. 6, a pedestal 4 on which a seat 2 is mounted is so supported on a movable mount 6 via connection links 5*a*, 5*b* as to rock forward and backward (first supporter), wherein the movable mount 6 is so supported on a horizontal base 8 as to rock to left and right (second supporter) and a driving device 13 is accommodated between the pedestal 4 and the movable mount 6. The connection links 5*a* are front links provided at the left and right sides of the pedestal 4, whereas the connection link 5*b* is a rear link provided in the widthwise center of the pedestal 4. The upper ends of the front links 5*a* are rotatably mounted on upper shaft pins 4*a* provided at the front end of the pedestal 4, whereas the bottom ends thereof are rotatably mounted on lower shaft pins 7*a* provided at the front ends of side plates 16 of the movable mount 6. Further, the upper end of the rear link 5*b* is rotatably mounted on an upper shaft pin 4*b* provided at the rear end of the pedestal 4, whereas the bottom end thereof is rotatably mounted on a lower shaft pin 7*b* provided at the rear ends of the side plates 16 of the movable mount 6. The respective front and rear lower shaft pins 7*a*, 7*b* construct transverse shafts for rotatably supporting the connection links 5*a*, 5*b* about an axis line of transverse direction Y, whereby the pedestal 4 can make reciprocating pivotal movements along longitudinal direction shown by arrows M in FIG. 6 about the transverse shafts 7*a*, 7*b*.

Shaft supporting plates 24 stand at the opposite front and rear ends of the base 8 and coupling plates 25 facing the shaft supporting plates 24 hang down from the opposite front and rear ends of the movable mount 6, wherein the coupling plates 25 are rotatably coupled to the corresponding shaft supporting plates 24 via longitudinal shafts 9*a*. The longitudinal shafts 9*a* are arranged at two front and rear positions in a middle portion of the base 8 to rotatably support the movable mount 6 about the longitudinal shafts 9*a*, whereby the pedestal 4 can make reciprocating pivotal movements along transverse direction about the longitudinal shafts 9*a* (as shown by arrows N of FIG. 4 in the first embodiment).

On the other hand, the driving device 13 is provided with a single motor 10, and two driving portions 13*a*, 13*b* for translating a torque from an output rotary shaft 12 of the motor 10 into reciprocating linear movements along longitudinal direction X, reciprocating pivotal movements about the transverse shafts 7*a*, 7*b*, and reciprocating pivotal movements about the longitudinal shafts 9*a* of the pedestal 4 and driving the seat 2 by combining these three kinds of movements. The motor (driving source) 10 of this example is vertically placed in the movable mount 6 on the base 8, and the output rotary shaft 12 projects upward.

The first driving portion 13*a* is for the reciprocating linear movements along longitudinal direction X and the reciprocating pivotal movements about the transverse shafts 7*a*, 7*b* (first translating mechanism), whereas the second driving portion 13*b* is for the reciprocating pivotal movements about the longitudinal shafts 9*a* (second translating mechanism). The first driving portion 13*a* includes a first shaft (first transverse shaft) 17 coupled to the output rotary shaft 12 via a motor gear 11 and a first gear 14, an eccentric crank 19 eccentrically coupled to an end of the first shaft 17, and an arm link 20 having one end coupled to the eccentric crank 19 and the other end rotatably mounted on a shaft pin 5*c* provided on the front link 5*a*. The opposite ends of the first shaft 17 are respectively rotatably supported on the movable mount 6, and the eccentric crank 19 makes eccentric circular movements with respect to the first shaft 17, whereby the front links 5*a* are reciprocated along longitudinal direction X via the arm link 20 and the pedestal 4 coupled to the connection links 5, i.e. the seat 2 can rock along directions shown by arrows M in FIG. 6. The eccentric crank 19 and the arm link 20 construct a crank arm.

The second driving portion 13*b* includes a second shaft (second transverse shaft) 18 coupled to a transmission gear 22 of the first shaft 17 via a second gear 15, and an eccentric rod 21 having one end coupled to an end of the second shaft 18 in an eccentric manner and having the other end rotatably coupled to the base 8. The opposite ends of the second shaft 18 are rotatably supported on the movable mount 6. The eccentric rod 21 is arranged at either the left or right side of the movable mount 6 (right side in FIG. 6); an upper end 21*a* of the eccentric rod 21 is coupled to the end of the second shaft 18 in an eccentric manner by a shaft pin 29; and a bottom end 21*b* of the eccentric rod 21 is rotatably coupled to an L-shaped fitting 27 fixedly attached to the base 8 by a shaft pin 28. Accordingly, the upper end 21*a* of the eccentric rod 21 makes eccentric circular movements as the second shaft 18 is rotated, whereby the pedestal 4, i.e. the seat 2 can make reciprocating pivotal movements about the longitudinal shafts 9*a*. These driving systems are the same as those shown in FIG. 5.

Figure 7:
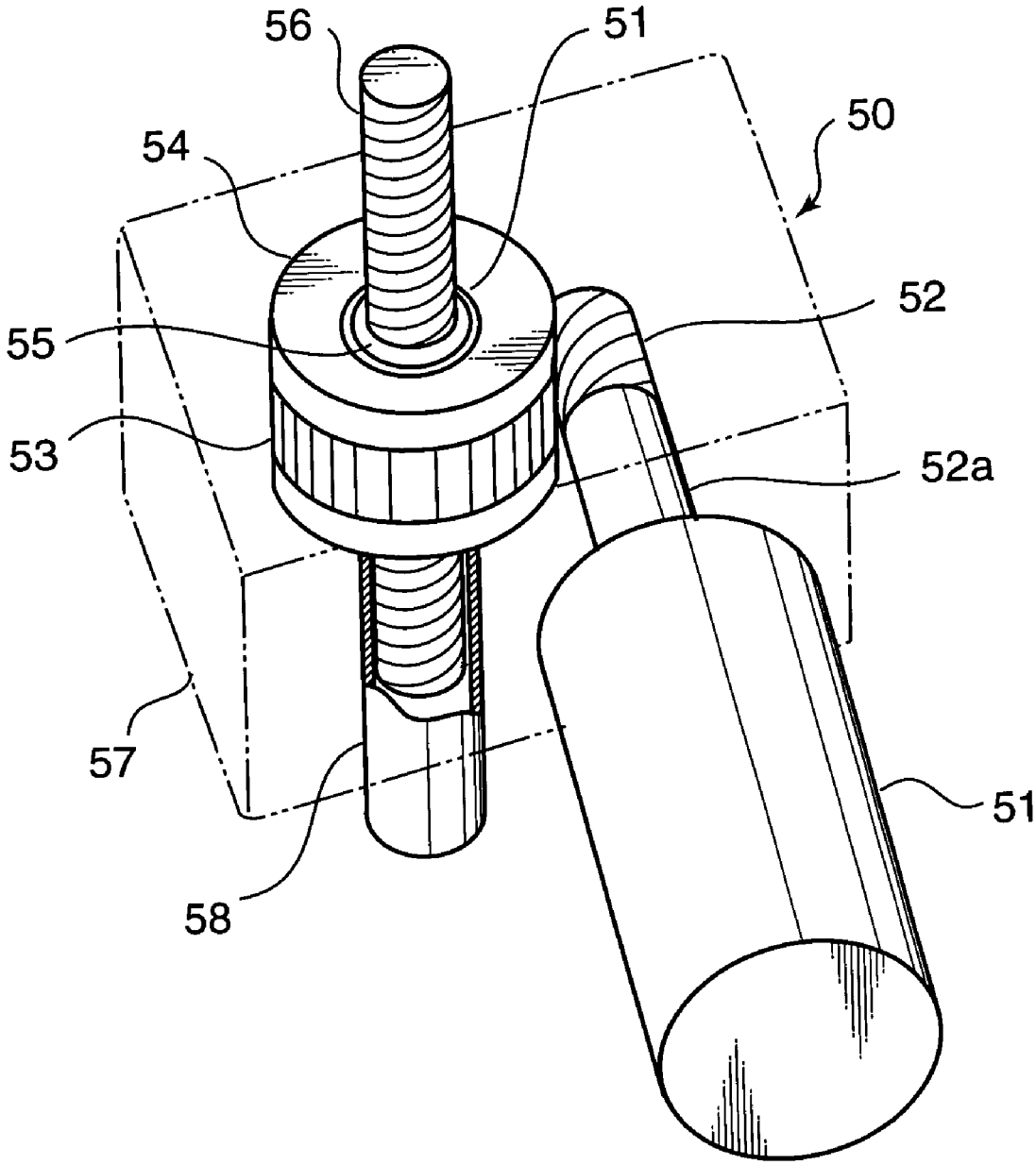
FIG. 7 is a perspective view of an elevating mechanism.

FIG. 7 is a perspective view of an elevating mechanism 50, which is inserted in the connection link 5*b* of the rocking exercise apparatus 1*a*. This elevating mechanism 50 includes a motor 51, a worm gear 52 mounted at the leading end of an output rotary shaft 51*a* of the motor 51, a worm wheel 53 engageable with the worm gear 52, bearings 54 rotatably supporting the worm wheel 52 from above and below, a nut 55 fitted to the worm wheel 53, and a screw 56 engaged with the nut 55. With the bearings 54 mounted in a casing 57, the upper end of the screw 56 is engaged with the pedestal 4 via an unillustrated engaging portion, and the base end of a guide 58 for guiding the bottom end of the screw 56 is engaged with the movable mount 6 via an unillustrated engaging portion.

Hereinafter, the operation of the rocking exercise apparatus 1*a* is described.

When the output rotary shaft 12 projecting in one direction from the motor 10 is rotated, the first shaft 17 is rotated by the engagement of the motor gear 11 and the first gear 14 and, simultaneously, the second shaft 18 is rotated by the engagement of the transmission gear 22 of the first shaft 17 and the second gear 15. When the first shaft 17 is rotated, the eccentric crank 19 coupled to the end of the first shaft 17 makes eccentric circular movements, whereby the front links 5*a* pivot along longitudinal direction X about the front transverse shaft 7*a* via the arm link 20. Since the rear link 5*b* cooperates to pivot about the rear transverse shaft 7*b* at this time, the pedestal 4, i.e. the seat 2 is reciprocated and rocked along longitudinal direction X. On the other hand, the upper end of the eccentric rod 21 makes eccentric circular movements by the rotation of the second shaft 18, whereby the pedestal 4, i.e. the seat 2 makes reciprocating pivotal movements about the longitudinal shafts 9.

At this time, the elevating mechanism 50 operates as follows.

When the output rotary shaft 52*a* of the motor 51 is rotated, the worm wheel 53 is rotated by the engagement with the worm gear 52 while being supported by the bearings 54. Then, the nut 55 fitted to the worm wheel 53 rotates together with the worm wheel 53. Then, the screw 56 engaged with the nut 55 is moved in the guide 58. The pedestal 4 is moved upward and downward relative to the movable mount 6 by the movement of the screw 56.

As described above, according to the second embodiment, the movable mount 6 provided on the base 8 is so supported as to make reciprocating pivotal movements about the longitudinal shafts 9 (first supporter); the pedestal 4 fixedly attached to the seat 2 is so supported as to make reciprocating pivotal movements about the transverse shafts 7*a*, 7*b* provided in the movable mount 6 via the connection links 5*a*, 5*b* (second supporter); the rotary motion of the output rotary shaft 12 of the motor 10 is translated into the reciprocating linear movements of the pedestal 4 along longitudinal direction and the reciprocating pivotal movements about the transverse shafts 7*a*, 7*b* via the second supporter by the first driving portion 13*a*; and the rotary motion of the output rotary shaft 12 of the motor 10 is translated into the reciprocating pivotal movements of the pedestal 4 about the longitudinal axis via the first supporter by the second driving portion 13*b*. In addition, since the connection link 5*b* is extended and contracted by the elevating mechanism 50, an angle of inclination changing function of inclining the seat 2 about the transverse shafts 7*a*, 7*b* is added to the conventional three kinds of movements disclosed in Unexamined Patent Publication No. 2004-216072, thereby complicating the exercise. Thus, a larger fitness effect than ever before can be obtained. For example, the user can train his abdominal muscle because he takes a forward inclined posture with the seat 2 inclined backward while being able to train his muscle of the back because he takes a backward inclined posture with the seat 2 inclined forward.

Third Embodiment

Figure 8:
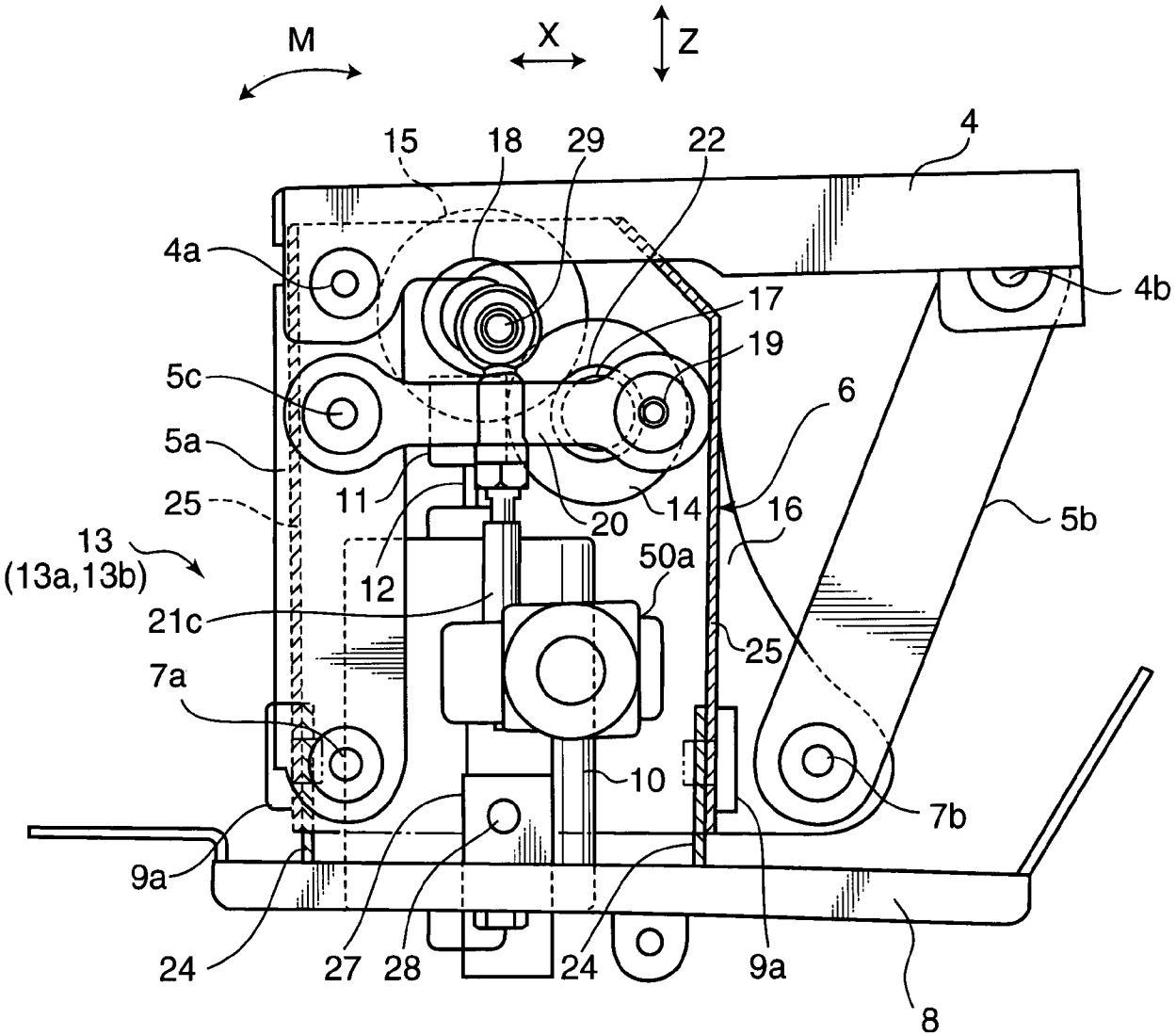
FIG. 8 is a side view showing the entire construction of a driving unit of a rocking exercise apparatus according to a third embodiment of the invention.

A transverse inclining function may be added to the conventional three kinds of movements disclosed in Unexamined Patent Publication No. 2004-216072. FIG. 8 is a side view showing the entire construction showing a driving unit of a rocking exercise apparatus 1*b* according to a third embodiment. Here, no repeated description is given since the construction other than an elevating mechanism 50*a* is the same as in the second embodiment.

The elevating mechanism (changer, extending and contracting mechanism) 50*a* has a construction similar to the one shown in FIG. 7, but differs from the one of the second embodiment in being inserted in an eccentric rod 21*c* of the rocking exercise apparatus 1*b*.

The elevating mechanism 50*a* operates as follows.

When an output rotary shaft 52*a* of a motor 51 is rotated, a worm wheel 53 is rotated by the engagement with a worm gear 52 while being supported by bearings 54. Then, a nut 55 fitted to the worm wheel 53 rotates together with the worm wheel 53. Then, a screw 56 engaged with the nut 55 is moved in a guide 58. A pedestal 4 is inclined to left and right relative to a movable mount 6 by the movement of the screw 56.

According to the third embodiment, the movable mount 6 provided on a base 8 is so supported as to make reciprocating pivotal movements about longitudinal shafts 9*a* (first supporter); the pedestal 4 fixedly attached to a seat 2 is so supported as to make reciprocating pivotal movements about transverse shafts 7*a*, 7*b* provided in the movable mount 6 (second supporter); the rotary motion of an output rotary shaft 12 of a motor (driving source) 10 is translated into reciprocating linear movements of the pedestal 4 along longitudinal direction and reciprocating pivotal movements thereof about the transverse shafts 7*a*, 7*b* via the second supporter by a first driving portion 13*a*; and the rotary motion of the output rotary shaft 12 of the motor 10 is translated into reciprocating pivotal movements of the pedestal 4 about the longitudinal shafts 9*a* via the first supporter by the second driving portion 13*b*. In addition, the eccentric rod 21 substantially coupling the base 8 and either the left or right surface of the movable mount 6 is extended and contracted by the elevating mechanism 50*a*, whereby an angle of inclination changing function of inclining the seat 2 about the longitudinal shafts 9*a* is added to the conventional three kinds of movements disclosed in Unexamined Patent Publication No. 2004-216072, thereby complicated exercise can be performed. Thus, a larger fitness effect than ever before can be obtained. For example, the user can train his left lateral muscle because he takes a posture inclined toward left with the seat 2 inclined toward right while being able to train his right lateral muscle because he takes a posture inclined toward right with the seat 2 inclined toward left.

Although the longitudinally inclined shafts 9 are inclined down toward the back in the first embodiment, they may be inclined down toward the front. Further, if the functions of changing the angle of inclination to the front, back, left and right described in the second and third embodiment may be combined with the four kinds of movements of the first embodiment and the angle of inclination to the front, back, left and right is controlled in synchronism with the respective kinds of movements, even more complicated exercises are possible and an even larger fitness effect can be obtained. The four kinds of movements may be combined with extending and contracting movements of the leg portion 60. For example, a real feeling of horse riding can be added, for example, by lowering the seat 2 upon inclining the seat 2 forward and lifting the seat 2 upon inclining the seat 2 backward.

As described above, an inventive rocking exercise apparatus comprises a driving source and a rocking mechanism for translating a torque of an output rotary shaft of the driving source into rocking movements of a seat seated by a user. The rocking mechanism is provided with a first supporter for supporting a movable mount provided on a base such that the movable mount can make reciprocating pivotal movements about a longitudinal axis; a second supporter for supporting a pedestal fixedly attached to the seat such that the pedestal can make reciprocating pivotal movements about a transverse shaft provided in the movable mount via a connection link; a first translating mechanism for translating the rotary motion of the output rotary shaft of the driving source into reciprocating linear movements of the pedestal along longitudinal direction and reciprocating pivotal movements of the pedestal about a transverse axis via the second supporter; a second translating mechanism for translating the rotary motion of the output rotary shaft of the driving source into reciprocating pivotal movements of the pedestal about the longitudinal axis via the first supporter; and a changer for changing the movement condition of the reciprocating pivotal movement of at least one of the first supporter and the second supporter.

With such a rocking exercise apparatus, the movable mount provided on the base is so supported by the first supporter as to be capable of making reciprocating pivotal movements about the longitudinal axis, and the pedestal fixedly attached to the seat is so supported by the second supporter as to be capable of making reciprocating pivotal movements about the transverse shaft provided in the movable mount via the connection link. The first translating mechanism translates the rotary motion of the output rotary shaft of the driving source into the reciprocating linear movements of the pedestal along longitudinal direction and the reciprocating pivotal movements thereof about the transverse shaft via the second supporter, and the second translating mechanism translates the rotary motion of the output rotary shaft of the driving source into the reciprocating pivotal movements of the pedestal about the longitudinal shaft via the first supporter. The changer changes the movement condition of the reciprocating pivotal movement of at least one of the first supporter and the second supporter, in other words, the angle of inclination of the movable mount with respect to the center axis of the reciprocating pivotal movements in at least either one of the first and second supporters is changeable. Thus, a function of changing the angle of inclination of the seat with respect to the transverse axis and/or the longitudinal axis is added to the conventional three kinds of movements disclosed in Japanese Unexamined Patent Publication NO. 2004-216072, thereby more complicated exercise can be performed. Thus, a larger fitness effect than ever before can be obtained. Further, since only one driving source is provided, it is possible to facilitate the control therefore and reduce the production cost. Furthermore, the exercise apparatus can be made smaller by narrowing the installation space of a driving unit.

The changer may preferably include an extending and contracting mechanism for extending and contracting the connection link of the second supporter.

Accordingly, the connection link of the second supporter is extended and contracted by the extending and contracting mechanism. Thus, the function of changing the angle of inclination of the seat with respect to the transverse axis and/or the longitudinal axis is added to the conventional three kinds of movements disclosed in Japanese Unexamined Patent Publication NO. 2004-216072, thereby more complicated exercise can be performed. Thus, a larger fitness effect than ever before can be obtained.

Preferably, the first translating mechanism may include a first transverse shaft provided on the movable mount and driven by a torque of the output rotary shaft of the driving source, and a crank arm having the base end thereof coupled to an end of the first transverse shaft in an eccentric manner and the leading end thereof rotatably coupled to an intermediate position of the connection link.

Preferably, the second translating mechanism may include a second transverse shaft provided on the movable mount and driven by a torque of the first transverse shaft, and an eccentric rod having the base end thereof rotatably supported on the base and the leading end thereof coupled to an end of the second transverse shaft in an eccentric manner.

Preferably, the second translating mechanism may further include an extending and contracting mechanism for extending and contracting the eccentric rod.

It may be preferable that the first translating mechanism includes a first transverse shaft provided on the movable mount and driven by the torque of the output rotary shaft of the driving source, and a crank arm having the base end thereof coupled to an end of the first transverse shaft in an eccentric manner and the leading end thereof rotatably coupled to an intermediate position of the connection link; the second translating mechanism includes a second transverse shaft provided on the movable mount and driven by a torque of the first transverse shaft, an eccentric rod having the base end thereof rotatably supported on the base and the leading end thereof coupled to an end of the second transverse shaft in an eccentric manner; and the changer includes an extending and contracting mechanism for extending and contracting the eccentric rod.

Accordingly, the eccentric rod substantially coupling the base and either the left or right surface of the movable mount is extended and contracted by the extending and contracting mechanism of the second supporter. Thus, the function of changing the angle of inclination of the seat with respect to the longitudinal axis is added to the conventional three kinds of movements disclosed in Japanese Unexamined Patent Publication NO. 2004-216072, thereby more complicated exercise can be performed. Thus, a larger fitness effect than ever before can be obtained.

This application is based on patent application Nos. 2004-290135 and 2004-334230 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A rocking exercise apparatus comprising a driving source and a rocking mechanism for translating a torque of an output rotary shaft of the driving source into rocking movements of a seat mounted by a user, wherein the rocking mechanism includes:

a first supporter for supporting a movable mount provided on a base such that the movable mount can make reciprocating pivotal movements about a longitudinal axis, a second supporter for supporting a pedestal fixedly attached to the seat such that the pedestal can make reciprocating pivotal movements about a transverse shaft provided in the movable mount via a connection link, a first translating mechanism for translating the rotary motion of the output rotary shaft of the driving source into reciprocating linear movements of the pedestal along longitudinal direction and reciprocating pivotal movements of the pedestal about a transverse axis via the second supporter, a second translating mechanism for translating the rotary motion of the output rotary shaft of the driving source into reciprocating pivotal movements of the pedestal about the longitudinal axis via the first supporter, and a changer for changing the movement condition of the reciprocating pivotal movement of at least one of the first supporter and the second supporter.

2. A rocking exercise apparatus as defined in claim 1, wherein the changer includes an extending and contracting mechanism for extending and contracting the connection link of the second supporter.

3. A rocking exercise apparatus as defined in claim 2, wherein the first translating mechanism includes a first transverse shaft provided on the movable mount and driven by a torque of the output rotary shaft of the driving source, and a crank arm having the base end thereof coupled to an end of the first transverse shaft in an eccentric manner and the leading end thereof rotatably coupled to an intermediate position of the connection link.

4. A rocking exercise apparatus as defined in claim 3, wherein the second translating mechanism includes a second transverse shaft provided on the movable mount and driven by a torque of the first transverse shaft, and an eccentric rod having the base end thereof rotatably supported on the base and the leading end thereof coupled to an end of the second transverse shaft in an eccentric manner.

5. A rocking exercise apparatus as defined in claim 4, wherein the second translating mechanism further includes an extending and contracting mechanism for extending and contracting the eccentric rod.

6. A rocking exercise apparatus as defined in claim 1, wherein:

the first translating mechanism includes a first transverse shaft provided on the movable mount and driven by the torque of the output rotary shaft of the driving source, and a crank arm having the base end thereof coupled to an end of the first transverse shaft in an eccentric manner and the leading end thereof rotatably coupled to an intermediate position of the connection link, the second translating mechanism includes a second transverse shaft provided on the movable mount and driven by a torque of the first transverse shaft, an eccentric rod having the base end thereof rotatably supported on the base and the leading end thereof coupled to an end of the second transverse shaft in an eccentric manner, and an extending and contracting mechanism for extending and contracting the eccentric rod, and the changer includes an extending and contracting mechanism for extending and contracting the eccentric rod.

7. A rocking exercise apparatus as defined in claim 1, wherein the first translating mechanism includes a first transverse shaft provided on the movable mount and driven by a torque of the output rotary shaft of the driving source, and a crank arm having the base end thereof coupled to an end of the first transverse shaft in an eccentric manner and the leading end thereof rotatably coupled to an intermediate position of the connection link.

* * * * *